US007195239B2

(12) United States Patent
Saito et al.

(10) Patent No.: US 7,195,239 B2
(45) Date of Patent: Mar. 27, 2007

(54) PRINTER AND PAPER FEED CONTROLLER

(75) Inventors: Hiroyuki Saito, Kanagawa-ken (JP); Michiharu Shoji, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/376,821

(22) Filed: Mar. 16, 2006

(65) Prior Publication Data

US 2006/0193672 A1 Aug. 31, 2006

Related U.S. Application Data

(63) Continuation of application No. 10/971,960, filed on Oct. 22, 2004, now Pat. No. 7,014,378.

(30) Foreign Application Priority Data

Oct. 31, 2003 (JP) ..... 2003-372458

(51) Int. Cl.
*B65H 7/00* (2006.01)

(52) U.S. Cl. ..... 271/256; 271/258.01

(58) Field of Classification Search ..... 400/578, 400/582, 596, 703, 709, 611; 271/256, 258.01
See application file for complete search history.

(56) References Cited

U.S. PATENT DOCUMENTS

| | | | | |
|---|---|---|---|---|
| 5,677,726 | A | 10/1997 | Fuse | |
| 6,188,422 | B1 | 2/2001 | Ogura | |
| 6,570,354 | B1 | 5/2003 | Dobbertin et al. | |
| 6,757,515 | B2 | 6/2004 | Ueda | |
| 6,862,427 | B2 | 3/2005 | Sato et al. | |
| 7,014,378 | B2 * | 3/2006 | Saito et al. | 400/582 |
| 2005/0254870 | A1 | 11/2005 | Takahashi | |

* cited by examiner

*Primary Examiner*—David H. Bollinger
(74) *Attorney, Agent, or Firm*—Canon U.S.A. Inc I.P. Div

(57) ABSTRACT

High accuracy is achieved in paper feed control without increasing the size of an encoder, which would result in an increase in cost. The velocity of a paper feeding mechanism is calculated from an edge signal that is generated by the encoder in response to the motion of the paper feeding mechanism. Based on the calculated velocity, a calculation is performed as to the time needed to reach a stop position since a detection of an encoder signal edge immediately before the stop position. Based on the calculated time, a control signal for stopping the paper feeding mechanism is generated.

6 Claims, 13 Drawing Sheets

PRINTER AND PAPER FEED CONTROLLER

This application is a continuation application of U.S. patent application Ser. No. 10/971,960 filed Oct. 22, 2004 now U.S. Pat. No. 7,014,378 which claims priority from Japanese Patent Application No. 2003-372458 filed Oct. 31, 2003, both of which are hereby incorporated by reference herein in their entirety.

BACKGROUND OF THE INVENTION

1. Field of the Invention

The present invention relates to a printer using a print head and a paper feed controller for controlling paper feed means for feeding a printing medium such as printing paper.

2. Description of the Related Art

In recent years, a great advance has been made in terms of image quality of an ink-jet printer. However, there is a continuing need for a further improvement in resolution which is one of factors of image quality. In a serial-type ink-jet printer, a carriage including a print head is scanned across a printing medium (hereinafter, also referred to as printing paper or simply as paper) while emitting ink with well controlled timing thereby forming an image. Each time the carriage is scanned across the paper, the paper is fed a predetermined distance.

The resolution of a printed image depends on carriage scanning resolution (resolution in the main scanning direction) and paper feed resolution (resolution in the sub scanning direction).

In order to achieve low operating noise and high accuracy in ink emission timing, the scanning of the carriage is generally performed by means of feedback control using a DC motor and an encoder. When low cost is more important than high performance, the scanning of the carriage is performed by means of feedfoward control using a pulse motor. In the feedback control, the ink emission timing is accurately controlled on the basis of encoder pulses. On the other hand, in the feedfoward control, on the assumption that the carriage moves at a constant velocity, the ink emission timing is determined on the basis of an applied pulse signal or a clock pulse signal.

The feeding of paper is also performed by means of feedback control using a DC motor and an encoder to achieve low operation noise and a high feeding speed.

In the feeding of paper, it is required to stop the paper when printing is performed. In the conventional technique, to precisely feed paper by a distance in small and precise units (with high resolution) to a next stop position, the resolution of the encoder is increased or the nozzle pitch of the print head is reduced. When neither the increasing of the resolution of the encoder nor the reducing of the nozzle pitch is possible, the stop position is determined such that the distance to the next stop position becomes equal to a common multiple of the minimum paper feeding unit and the nozzle pitch of the print head.

Regarding the increase in resolution of the encoder, a high-resolution encoder system used in industrial applications is expensive and thus unsuitable for use in general applications that need low-cost printers. Thus, in general, an encoder sensor with a resolution of 150 to 360 Lpi is used, and the ratio of the diameter of an encoder wheel to the diameter or a paper feed roller is set to be large enough to achieve high resolution.

It is also known to improve the accuracy of the stop position such that when the position reaches a point a predetermined distance before a next stop position, a calculation is performed to determine the time at which to turn off the electric power supplied to a motor. When the calculated time has elapsed, the electric power to the motor is turned off.

However, to improve the paper feed resolution of the conventional printer, many problems must be solved. Regarding the reduction in the nozzle pitch of the print head, the reduction is limited by limitations on the head design and production techniques and the upper limit of cost, and thus the improvement in resolution is not easy (in particular, the improvement needs a very large increase in cost).

In the technique of determining the stop position such that the distance to the next stop position becomes equal to a common multiple of the minimum paper feeding unit and the nozzle pitch of the print head, the paper feeding distance does not have a simple value (deviated from 2 raised to nth power) and thus a complicated calculation is needed in image processing. Furthermore, all nozzles are not equally used, but particular nozzles are used more frequently than the other nozzles. This can cause a reduction in performance of the print head. A further problem of this technique is that a restriction is imposed on the design of the diameter of the paper feed roller and the diameter of the encoder wheel.

To improve the accuracy of the stop position, it is needed to acquire a large amount of information very shortly before the paper feed roller is stopped. If the stop position is controlled such that it is located at a position exactly corresponding to a slit signal (a rising or falling edge of phase A or B), high accuracy in the stop position can be achieved. However, in this technique, the resolution is limited to 2 raised to nth power such as 1200 dpi, 2400 dpi, 4800 dpi and so on.

On the other hand, to increase the amount of information obtained very shortly before the stop position, it is needed to increase the size of the encoder wheel connected to the paper feed roller, which results in an increase in the total size of the printer. Besides, if the amount of information is increased, it becomes necessary to process the large amount of information, which can cause an increase in processing time and a reduction in throughput.

If the reduction in the total size or the increase in operating speed is given higher priority in the design of the printer, the amount of information becomes smaller (for example, by a factor of ½, due to the limitation of the resolution to 2 raised to nth power) than can be obtained when the amount of information is given higher priority in the design. This can make it impossible to obtain information necessary in a low-velocity region very shortly before the paper feed roller is stopped. The lack of a sufficient amount of information makes it impossible to precisely determine the velocity immediately before the stop position and thus the stop position accuracy becomes low.

For example, when the print head has a nozzle pitch of 1200 dpi, resolution of 1200 dpi can be achieved by controlling the paper feed roller based on a single edge/single phase control scheme, resolution of 2400 dpi can be achieved using a two edge/single phase control scheme, and resolution of 4800 dpi can be achieved using a two edge/two phase control scheme, and thus all resolutions of 1200 dpi, 2400 dpi, and 4800 dpi can be achieved in the paper feed direction.

However, information can be acquired only at intervals of 4800 dpi in a very short period immediately before paper is stopped. Because the paper feeding velocity is very low in the very short period immediately before the paper is stopped, information can be obtained a very small number of times. For example, when the servo control period of the feedback control is 1 ms, information is acquired only once when a servo interrupt occurs, even in the two edge/two phase control scheme. In such a situation, the accuracy of the calculated velocity becomes low. Thus, controlling of the feeding of paper in the very low velocity range is difficult. This makes it difficult to precisely control the stop position.

If the paper feed roller can be controlled using the single edge/single phase control scheme with a resolution of 2400 dpi, a resolution of 4800 dpi can be realized using the two edge/single phase control scheme. However, although high accuracy twice that obtained in the previous example is achieved, the diameter of the encoder wheel becomes twice as large as that in the previous example, and thus it becomes difficult to achieve a small total size. Besides, the encoder wheel cannot be rotated at a high speed unless the sensor has a correspondingly high response speed.

It is known to increase the stop position accuracy by performing a stop operation such that when a predetermined distance before a target stop position is reached, a calculation is performed as to the time when to perform the stop operation, and electric power to a motor is turned off when the calculated time has elapsed. However, in this technique, the maximum stop position error is not guaranteed, and thus this technique cannot be used when high stop position accuracy is required and the maximum stop position error must be guaranteed.

In general, because the velocity in the low velocity range is calculated based on a small number of encoder pulses, it is difficult to achieve high accuracy in the calculated velocity. Besides, the velocity can fluctuate due to a disturbance such as mechanical friction, a back tension of paper, a fluctuation of a driving force transmission load, or cogging of a motor.

In practice, as described above, in the above-described technique of turning off the electric power to the motor at the time calculated based on the velocity calculated at the position the predetermined distance before the target stop position, it is difficult to precisely calculate the timing of turning off the electric power to the motor. Besides, a varying deviation of the stop position from the target stop position occurs after the electric power to the motor is turned off, owing to a disturbance before the paper feed roller stops, such as the back tension of paper, the fluctuation of the driving force transmission load, or cogging of the motor.

SUMMARY OF THE INVENTION

In view of the above, it is an object of the present invention to provide a paper feed controller and a printer using a paper feed controller, capable of precisely feeding paper with a high feeding resolution.

In an aspect, the present invention provides a paper feed controller comprising paper feed means, a motor for driving the paper feed means, and encoder means for outputting a first detection signal and a second detection signal in response to movement of the paper feed means, the paper feed controller further comprising acquisition means for acquiring a stop position of the paper feed means, output means for outputting a stop signal for stopping the paper feed means, velocity calculation means for calculating the velocity of the paper feed means before a time corresponding to the stop position, time calculation means for calculating the time needed to reach the time corresponding to the stop position since a time at which there occurs a particular edge of the first detection signal output before the time corresponding to the stop position, counting means for counting the time calculated the time calculation means, and control means for controlling the output means to output the stop signal when the counting of the time performed by the counting means is completed, wherein when an edge of the second detection signal is detected after the detection of the particular edge of the first detection signal, the control means controls the output means to output the stop signal even if the counting performed by the counting means is not completed.

In another aspect, the present invention provides a printer for printing using a print head, comprising paper feed means, a motor for driving the paper feed means, and encoder means for outputting a first detection signal and a second detection signal in response to movement of the paper feed means, the printer further comprising acquisition means for acquiring a stop position of the paper feed means, output means for outputting a stop signal for stopping the paper feed means, velocity calculation means for calculating the velocity of the paper feed means before a time corresponding to the stop position, time calculation means for calculating the time needed to reach the time corresponding to the stop position since a time at which there occurs a particular edge of the first detection signal output before the time corresponding to the stop position, counting means for counting the time calculated the time calculation means, and control means for controlling the output means to output the stop signal when the counting of the time performed by the counting means is completed, wherein when an edge of the second detection signal is detected after the detection of the particular edge of the first detection signal, the control means controls the output means to output the stop signal even if the counting performed by the counting means is not completed.

Further objects, features and advantages of the present invention will become apparent from the following description of the preferred embodiments with reference to the attached drawings.

DESCRIPTION OF THE PREFERRED EMBODIMENTS

First Embodiment

Figure 1:
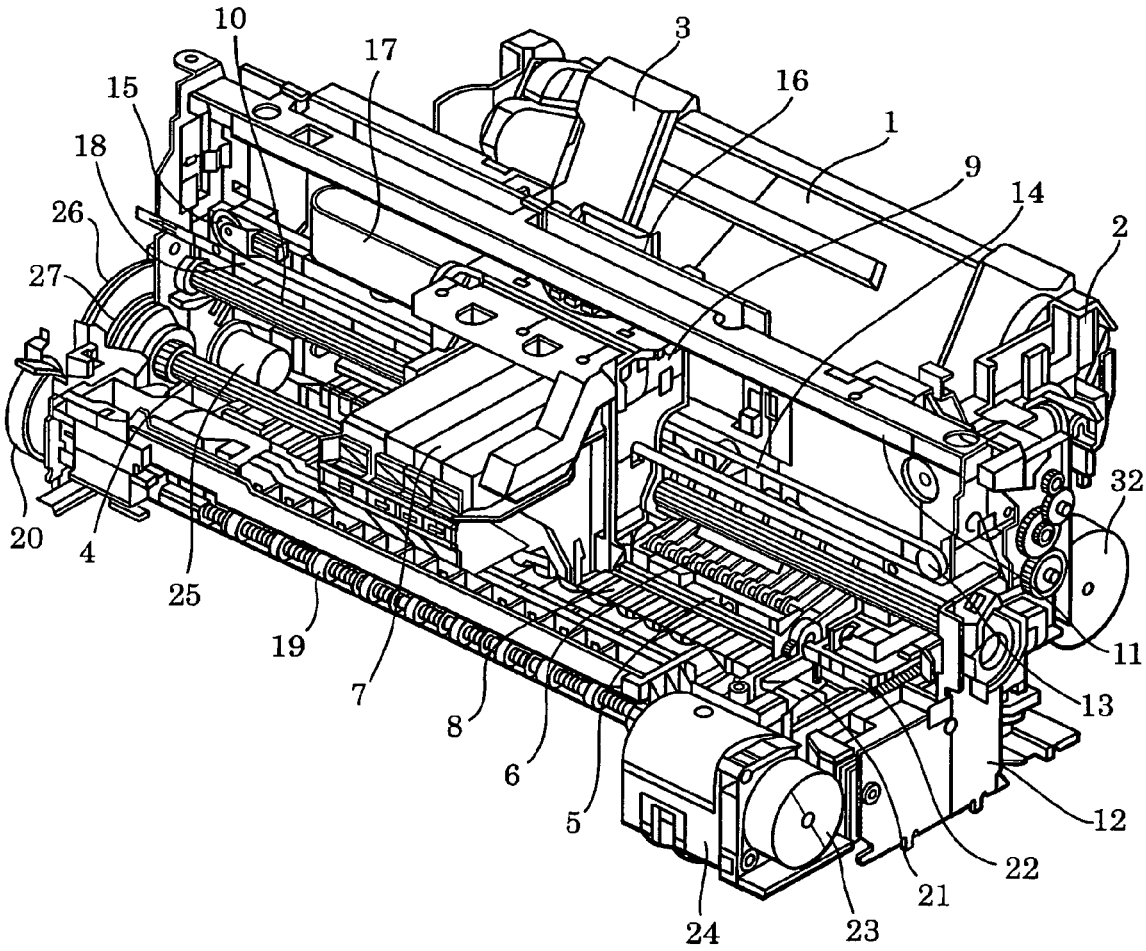
FIG. 1 is a perspective view of mechanical parts of a printer according to a first embodiment of the invention.
Figure 2:
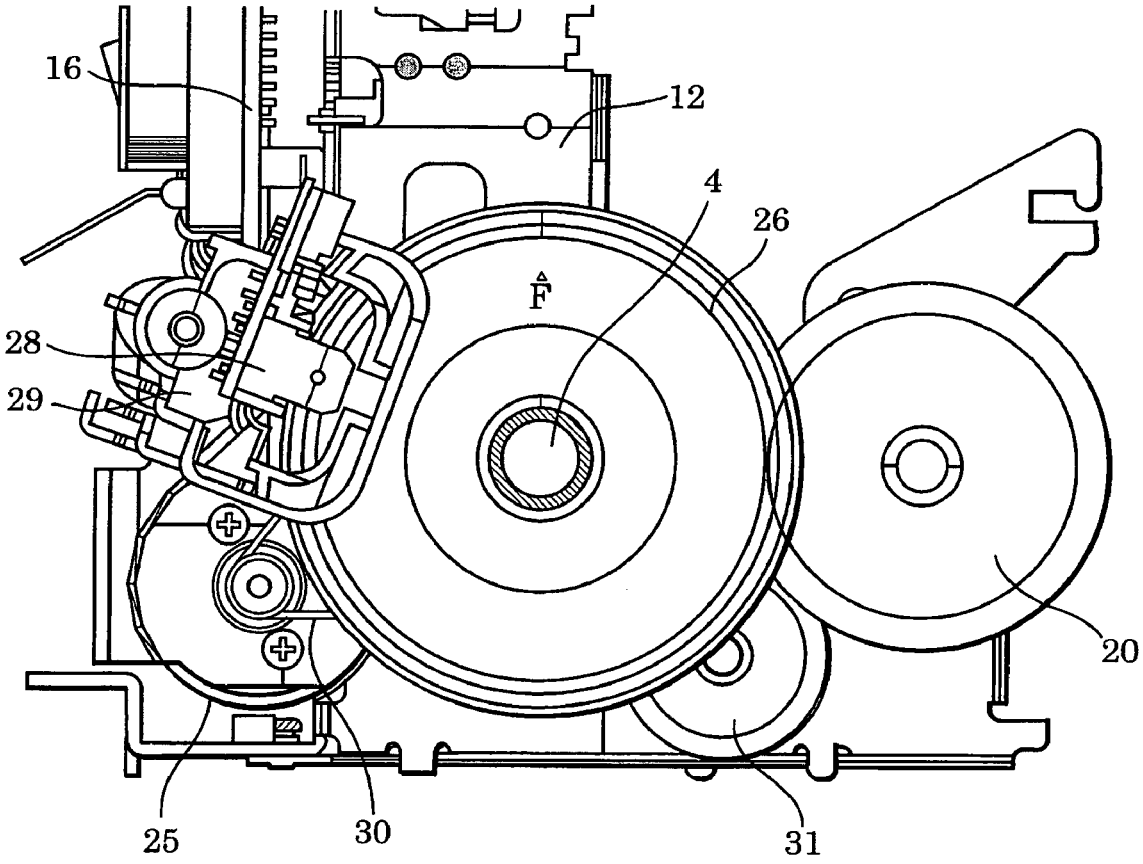
FIG. 2 is a side view of a paper feed mechanism according to the first embodiment of the invention.

FIG. 1 is a general perspective view of a printer, and FIG. 2 is a side view of a paper feeding system.

The printer includes an automatic document feeder, a paper transport mechanism, a paper ejection unit, a carriage unit, and a cleaning unit. The outline of each of these parts is described below.

(A) Automatic Document Feeder

The automatic document feeder includes a platen 1 on which to place a stack of paper P and a base 2 having a paper feed roller (not shown) for feeding paper P. A movable side guide 3 is movably disposed on the platen 1 so that the movable side guide 3 defines the position at which the stack of paper P is placed. The platen 1 is rotatable about a shaft connected to the base 2 and is urged against the paper feed roller by a platen spring (not shown).

Some sheets of paper P are fed by the driving force of a paper feed motor 32 to a nip part formed by the paper feed roller and a separation roller (not shown). The sheets of paper P are separated by the nip part and only one sheet at the top is further fed.

(B) Paper Transport Mechanism

A paper transport mechanism includes a paper feed roller 4 for feeding paper P and a paper end detector (not shown). A pinch roller 5 is disposed such that it is in contact with the paper feed roller 4 and rotates following the rotation of the paper feed roller 4. The pinch roller 5 is supported by a pinch roller guide 6 and is urged by a pinch roller spring (not shown) into contact with the paper feed roller 4 thereby creating a driving force of feeding paper P. A head cartridge set 7 for forming an image in accordance with image information are disposed, at a downstream location in a paper feed path, close to the paper feed roller 4.

An LF encoder sensor 28 is fixed to an LF encoder sensor holder 29 fixed to a chassis 12. A driving force generated by an LF motor 25 is transmitted via an LF timing belt 30 to a paper feed roller gear 27 press-fitted with the paper feed roller 4. The number of lines of an LF encoder scale 26 inserted in the paper feed roller 4 and fixed to the paper feed roller gear 27 is read by the LF encoder sensor 28 and thus information indicating the amount of rotation (angular velocity) of the paper feed roller 4 is obtained. On the basis of the amount of rotation (angular velocity), a control circuit such as a CPU performs feedback control such that a DC motor serving as an LF motor 25 rotates at a desired speed. The paper P is fed by the paper feed roller 4 driven by the LF motor 25.

Herein, the LF encoder sensor 28 is assumed to be a digital-output encoder. When paper P is fed to the paper transport mechanism, the paper P is transported to a roller pair of the paper feed roller 4 and the pinch roller 5 under the guidance of the pinch roller 6 and a paper guide (not shown). The paper end detector detects a leading end of the recording paper P being transported, and a printing position on the recording paper P is determined based on the detection of the leading end. In the printing operation, the paper P is fed over the platen 8 by the rotation of the pair of rollers 4 and 5.

(C) Carriage Unit

The carriage unit includes a carriage 9 on which the head cartridge set 7 is mounted. The carriage 9 is held by a guide shaft 10 such that the carriage 9 can move back and forth along the guide shaft 10 in a direction perpendicular to the direction in which the paper P is fed, and the upper rear end of the carriage 9 is held by a guide rail 11 such that the print heads 7 are spaced by a fixed gap from the paper P. The guide shaft 10 and the guide rail 11 are fixed to the chassis 12.

The carriage 9 is driven by a DC motor serving as a carriage motor 13 fixed to the chassis 12 via the timing belt 14. The timing belt 14 is held in a stretched form by an idle pulley 15. A flexible cable 17 is connected to the carriage 9 such that head signals are transmitted from an electric circuit board 16 to the head cartridges 7 via the flexible cable 17. A linear encoder (not shown) for detecting the position of the carriage is disposed on the carriage 9. The linear encoder reads the number of lines of the linear scale 18 attached to the chassis 12 thereby detecting the position of the carriage 9. A signal output from the linear encoder 18 is transmitted to the electric circuit board 16 via the flexible cable 17 and processed by the electric circuit board 16.

In the printer constructed in the above-described manner, when an image is formed on paper P, the paper P is fed by the pair of rollers 4 and 5 to a row position (a position in the direction in which the paper P is fed) at which an image should be formed, and the carriage 9 is moved to a column position (a position in the direction perpendicular to the paper feed direction) by means of feedback control using a carriage motor 13 and a linear encoder such that the head cartridge set 7 is located at a position at which the image should be formed. Thereafter, ink is emitted from the head cartridge set 7 in accordance with a signal supplied from the electric circuit board 16 thereby forming the image.

(D) Paper Ejection Unit

The paper ejection unit includes a paper ejection roller 19 and wheels (not shown) that are kept in contact with the paper ejection roller 19 such that the wheels rotate following the rotation of the paper ejection roller 19. A driving force of the paper feed roller gear 27 is transmitted to the paper ejection roller 19 via a paper ejection transmission gear 31 and a paper ejection roller gear 20. After the complete image is formed on the paper P by the carriage unit while being fed, the paper P is transported by the nip formed by the paper ejection roller 19 and the wheels to an output paper tray or the like (not shown).

(E) Cleaning Unit

The cleaning unit includes a pump 24 for cleaning the head cartridges 7, a cap 21 for preventing the head cartridges 7 from being dried, a wiper 22 for cleaning the face of the head cartridges 7, and a PG motor 23 serving as a driving force source.

Figure 3:
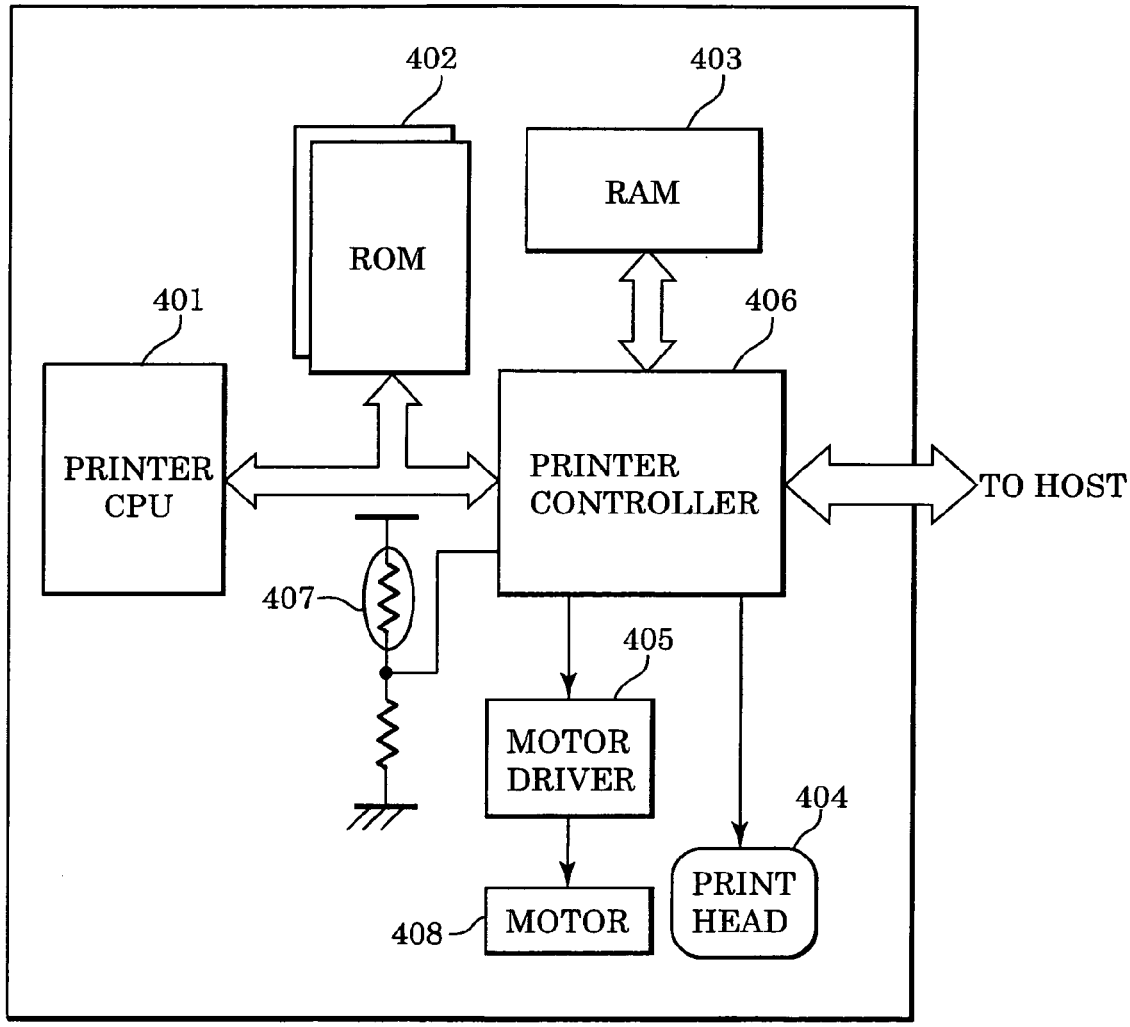
FIG. 3 is a block diagram showing a printer controller according to the first embodiment of the invention.

FIG. 3 is a block diagram showing a printer control circuit formed on the electric circuit board 16. In FIG. 3, a printer CPU 401 controls a printing operation in accordance with a printer control program, a printer emulation program, and font data stored in a ROM 402.

A RAM 403 is used to store rendered print data. The RAM 403 is also used to store data received from a host device. The printer control circuit also includes a print head 404

(corresponding to the head cartridge set 7 described earlier), a motor driver 405 for driving a motor 408, a printer controller 406 (for example, in the form of an ASIC) for controlling accessing to the RAM 403, transmitting/receiving of data to/from the host device, and transmitting of a control signal to the motor driver. The control signal includes a stop command signal for stopping the operation of paper feed means described later. A temperature sensor 407 formed of a thermistor or the like detects the temperature of the printer.

The CPU 401 controls mechanical components and electrical components of the printer according to the control program stored in the ROM 402 and concurrently reads, via an I/O data register in the printer controller 406, information such as an emulation command transmitted to the printer from the host device and performs a control operation in accordance with the command.

Figure 4:
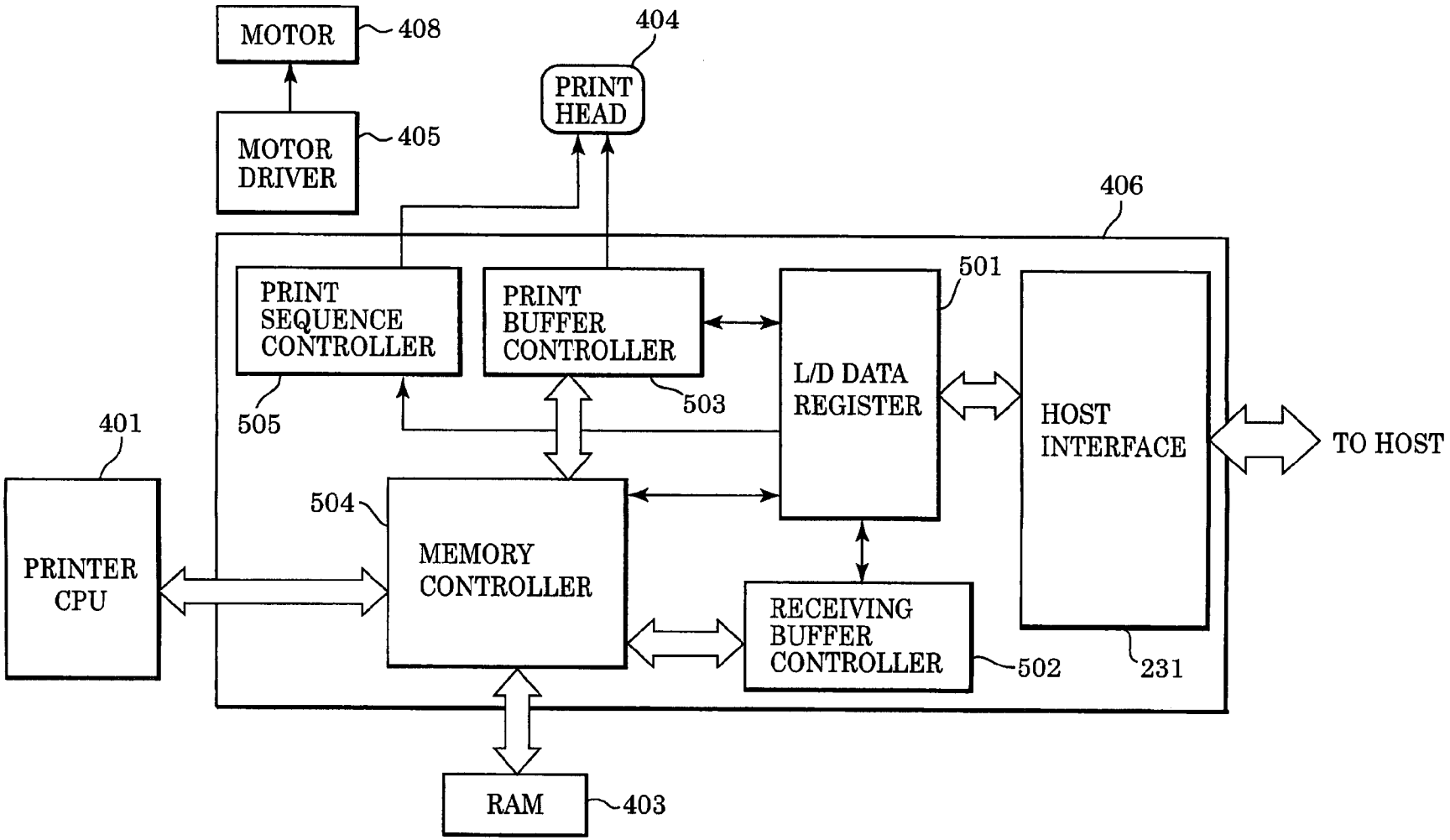
FIG. 4 is a block diagram showing a printer controller according to the first embodiment of the invention.

FIG. 4 is a block diagram showing the details of the printer controller 406 shown in FIG. 3, wherein similar parts to those in FIG. 3 are denoted by similar reference numerals.

In FIG. 4, an I/O register 501 transmits and receives command-level data to or from the host device. A receiving buffer controller 502 transfers received data from the register to the RAM 403.

When printing is performed, a print buffer controller 503 reads print data from a print data buffer of the RAM and transfers the read print data to the print head 404. A memory controller 504 controls accessing to the RAM 403 from three directions. A print sequence controller 505 controls a print sequence. A host interface 231 performs communication with the host device.

Figure 5:
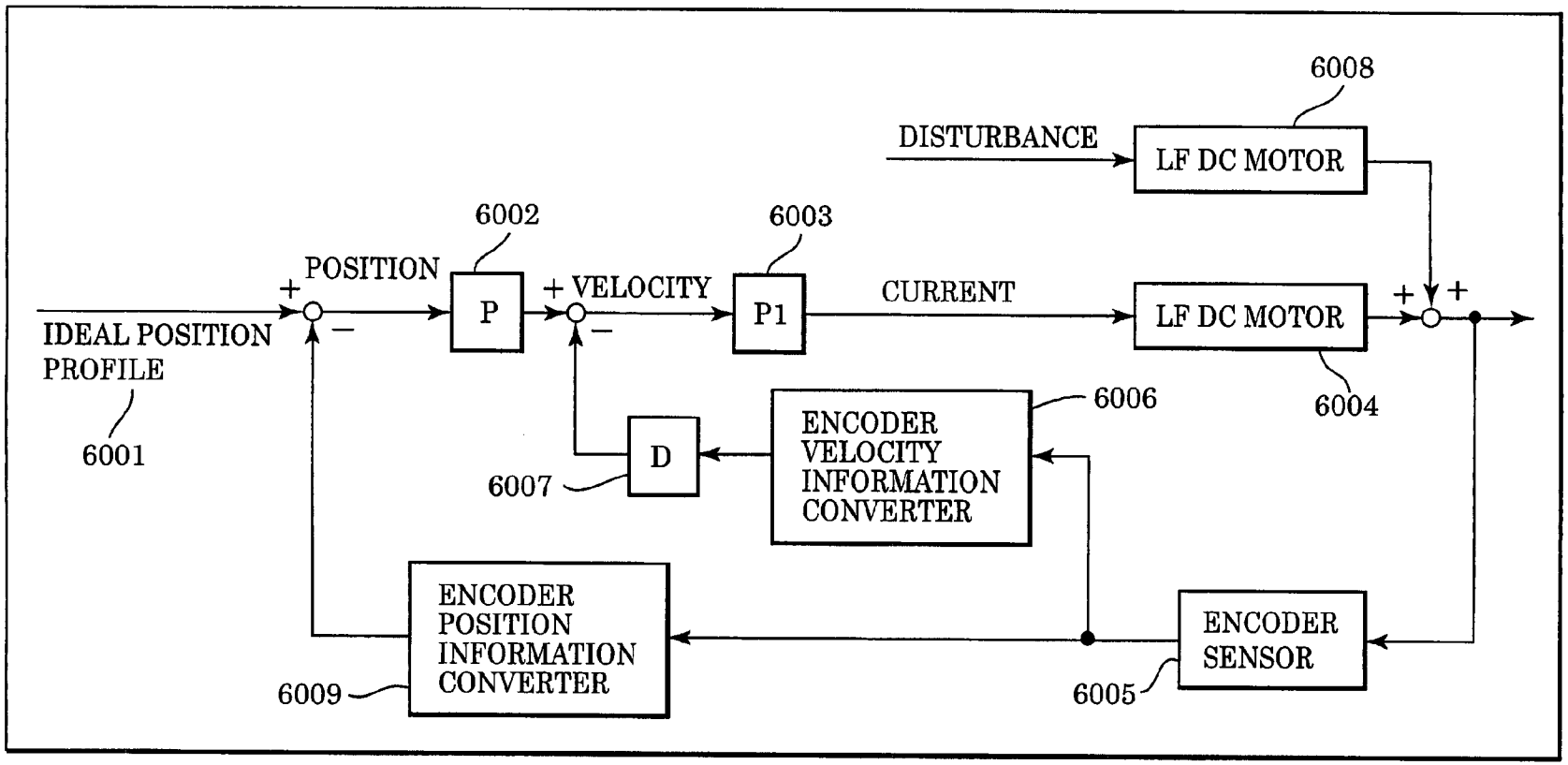
FIG. 5 is a block diagram of a DC motor position control system according to the first embodiment of the invention.

FIG. 5 is a block diagram of a general DC motor position control system based on position servo control. In the present embodiment, the position servo control is used in an acceleration control mode (section), a constant velocity control mode (section), and a deceleration control mode (section). The DC motor is controlled by means of a PIC control technique that is also called a classic control technique, as described below.

A target position to which paper should be moved is given in the form of an ideal position profile 6001. In the present embodiment, the ideal position profile 6001 indicates the absolute position at which paper being fed by the line feed motor should arrive at a particular time. The target position varies with time. In the present embodiment, the feeding of paper is controlled so as to follow up the ideal position profile.

The position control system includes an encoder sensor 6005 for detecting the physical rotation of a motor. An encoder position information converter 6009 calculates the cumulative sum of the number of slits detected by the encoder sensor thereby obtaining absolute position information. An encoder velocity information converter 6006 calculates the current driving velocity of the line feed motor from the signal supplied from the encoder sensor and a clock signal generated by an internal clock disposed in the printer.

The value of the actual physical position output by the position information converter 6009 is subtracted from the ideal position profile 6001, and the result indicating the value by which the current physical position is smaller than the ideal position profile is transferred as a position error to a position feedback process performed by a block 6002 that is a major loop in the position servo control system and that includes, in general, a calculation associated with a proportional term P.

As a result of the calculation by the major loop 6002, a target velocity value is output and supplied to a velocity servo feedback control loop 6003 that is a minor loop in the servo control system and includes, in general, a PID calculation associated with the proportional term P, an integral term, and a differential term D. In order to improve the follow-up performance in a state in which a nonlinear change occurs in the target velocity value and also in order to remove an evil in the differential calculation in the follow-up control, the present embodiment uses a technique in which the encoder velocity information obtained via the encoder velocity information converter 6006 is first subjected to a differential operation by a block 6007 before the difference from the target velocity value is calculated by the block 6002. However, this technique is not essential to the present invention. Depending on the performance of the system to be controlled, the differential operation may be performed by the block 6003 instead of the block 6007.

In the minor loop of the velocity servo feedback control, the encoder velocity value is subtracted from the target velocity value, and the result indicating the value by which the encoder velocity value is smaller than the target velocity value is supplied as a velocity error to a PI calculator 6003. The PI calculator 6003 calculates the energy to be applied to the DC motor by means of a technique called a PI calculation. In response to receiving data indicating the energy to be applied to the DC motor 6004, the motor driver circuit controls the speed of the DC motor 6004 by controlling the energy applied to the DC motor 6004 by changing the duty of the applied voltage pulse, that is, by changing the pulse width while maintaining the height of the applied voltage pulse (hereinafter, this technique will be referred to as a PWM (Pulse Width Modulation) technique).

The current applied to the DC motor causes the DC motor to physically rotate with a disturbance 6008. The output of the physical rotation of the DC motor is detected by the encoder sensor 6005.

Figure 6:
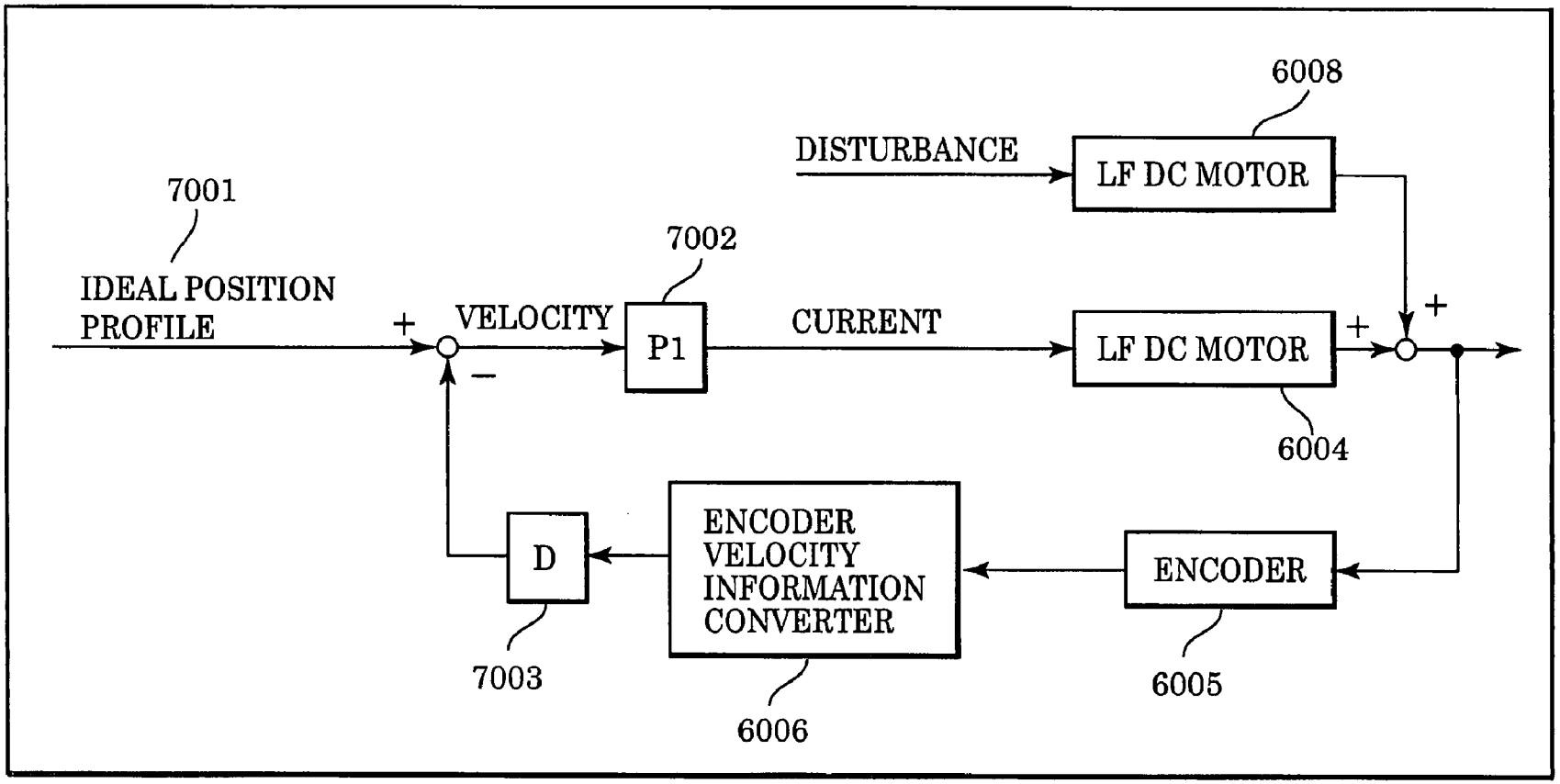
FIG. 6 is a block diagram of a DC motor velocity control system according to the first embodiment of the invention.

FIG. 6 is a block diagram of a general velocity control system of controlling the velocity of the DC motor by means of velocity servo control. In the present embodiment, the velocity servo control is used in a positioning control section. The DC motor is controlled by a conventional technique well known as a PID control, as described below.

A target velocity at an actual velocity should be controlled is given in the form of an ideal velocity profile 7001. In the present embodiment, the ideal velocity profile 7001 indicates the ideal velocity at which paper being fed by the line feed motor should be controlled. That is, the ideal velocity profile 7001 indicates the target velocity value as a function of time. In the present embodiment, the feeding of paper is controlled so as to follow up the ideal velocity profile.

In general, the velocity servo control is performed by means of a PID calculation associated with a proportional term P, an integral term, and a differential term D. In order to improve the follow-up performance in a state in which a nonlinear change occurs in the target velocity value and also in order to remove an evil in the differential calculation in the follow-up control, the present embodiment uses a technique in which the encoder velocity information obtained via the encoder velocity information converter 6006 is first subjected to a differential operation by a block 7003 before the difference from the target velocity value is calculated by the block 7001. However, this technique is not essential to the present invention. Depending on the performance of the system to be controlled, the differential operation may be performed by the block 7002 instead of the block 7003.

In the velocity servo control, the encoder velocity value is subtracted from the target velocity value, and the result indicating the value by which the encoder velocity value is smaller than the target velocity value is supplied as a velocity error to a PI calculator 7002. The PI calculator 7022 calculates the energy to be applied to the DC motor by means of the technique called the PI calculation. In response to receiving data indicating the energy to be applied to the DC motor 6004, the motor driver circuit controls the speed of the DC motor 6004 by controlling the energy applied to the DC motor 6004 by changing the duty of the applied voltage pulse by means of the PWM technique.

The current applied to the DC motor causes the DC motor to physically rotate with a disturbance 6008. The output of the physical rotation of the DC motor is detected by the encoder sensor 6005.

Figure 7:
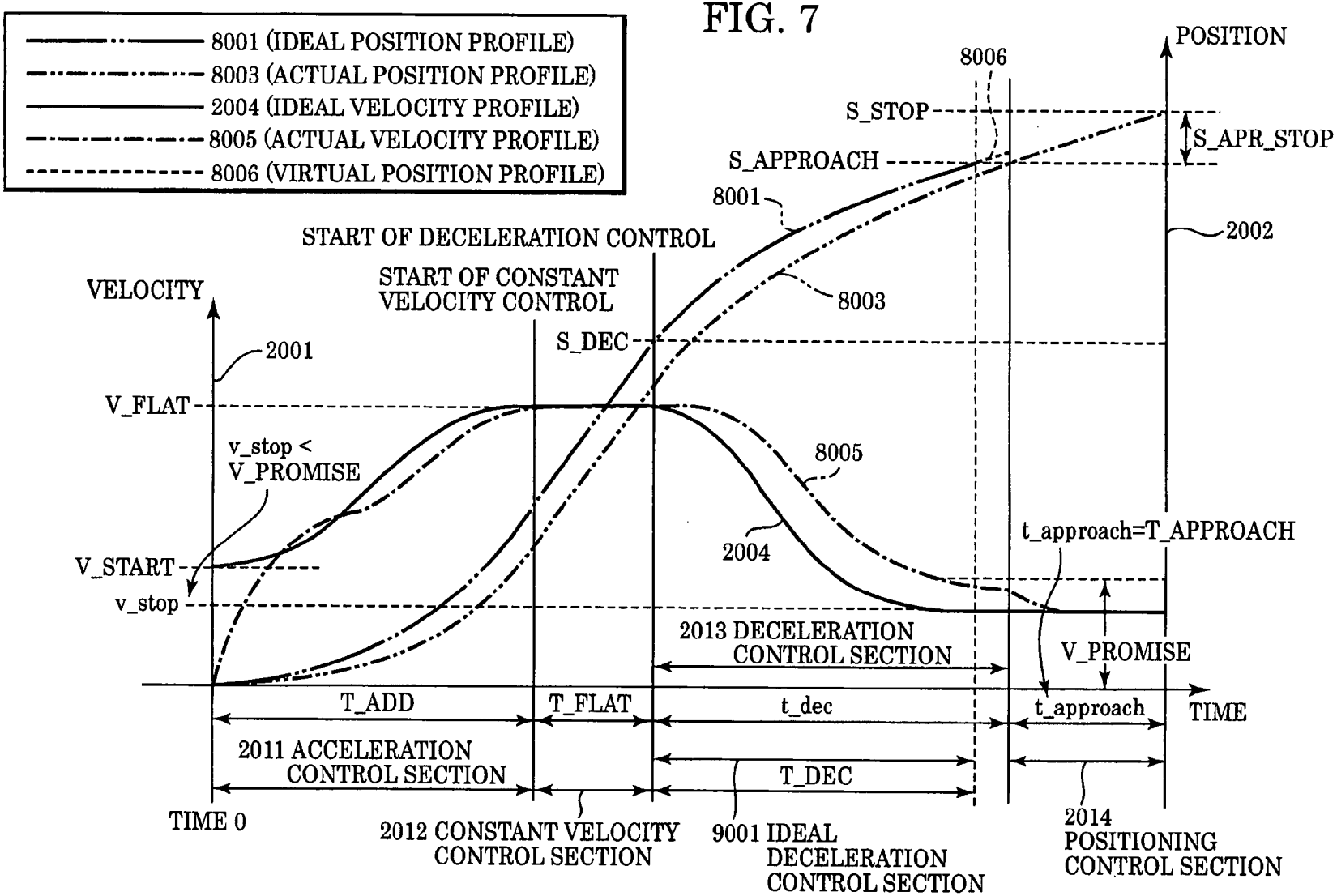
FIG. 7 is a diagram conceptually illustrating an influence of a disturbance on control according to the first embodiment of the invention.
Figure 8:
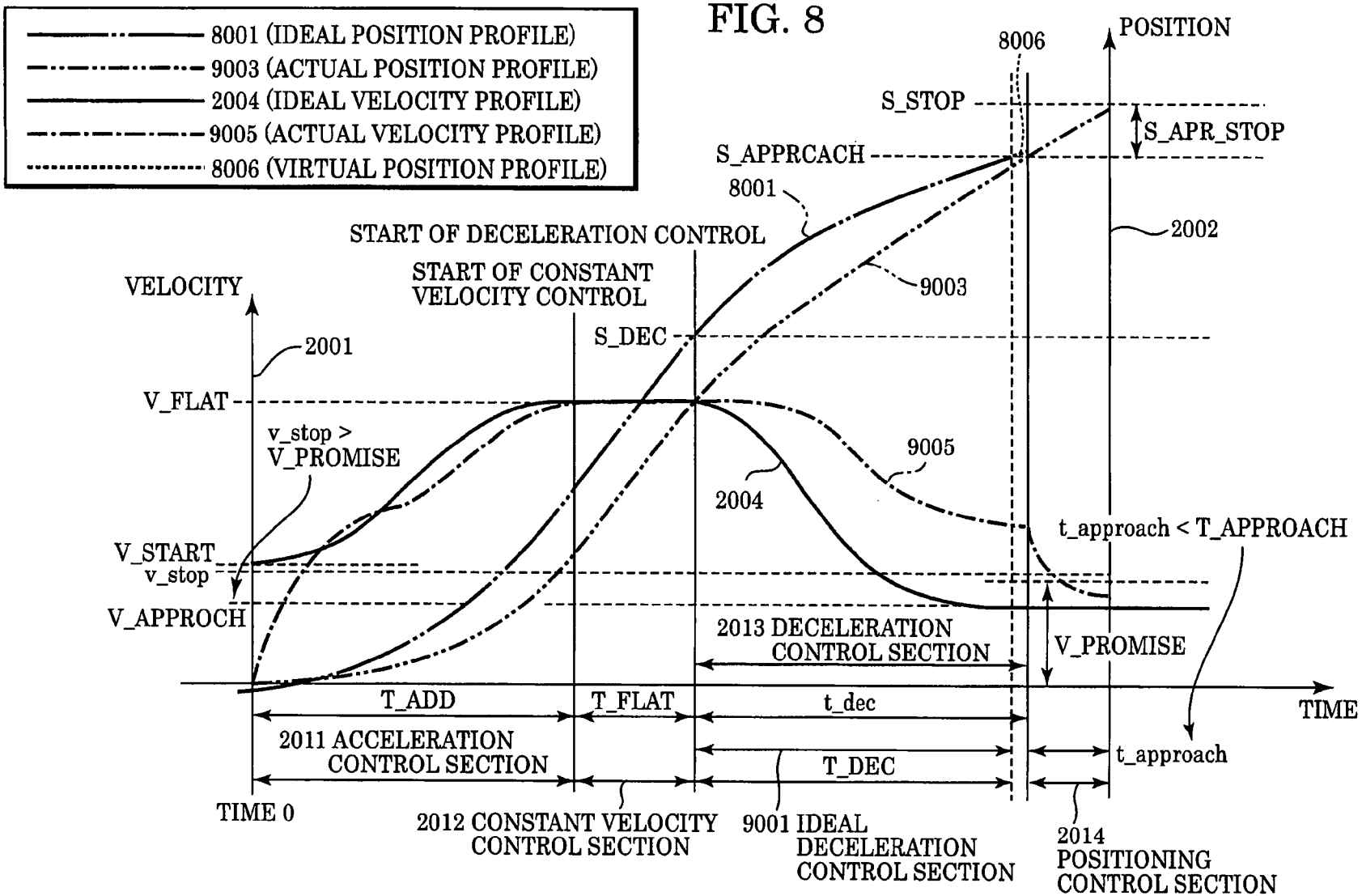
FIG. 8 is a diagram conceptually illustrating an influence of a disturbance on control according to the first embodiment of the invention.
Figure 9:
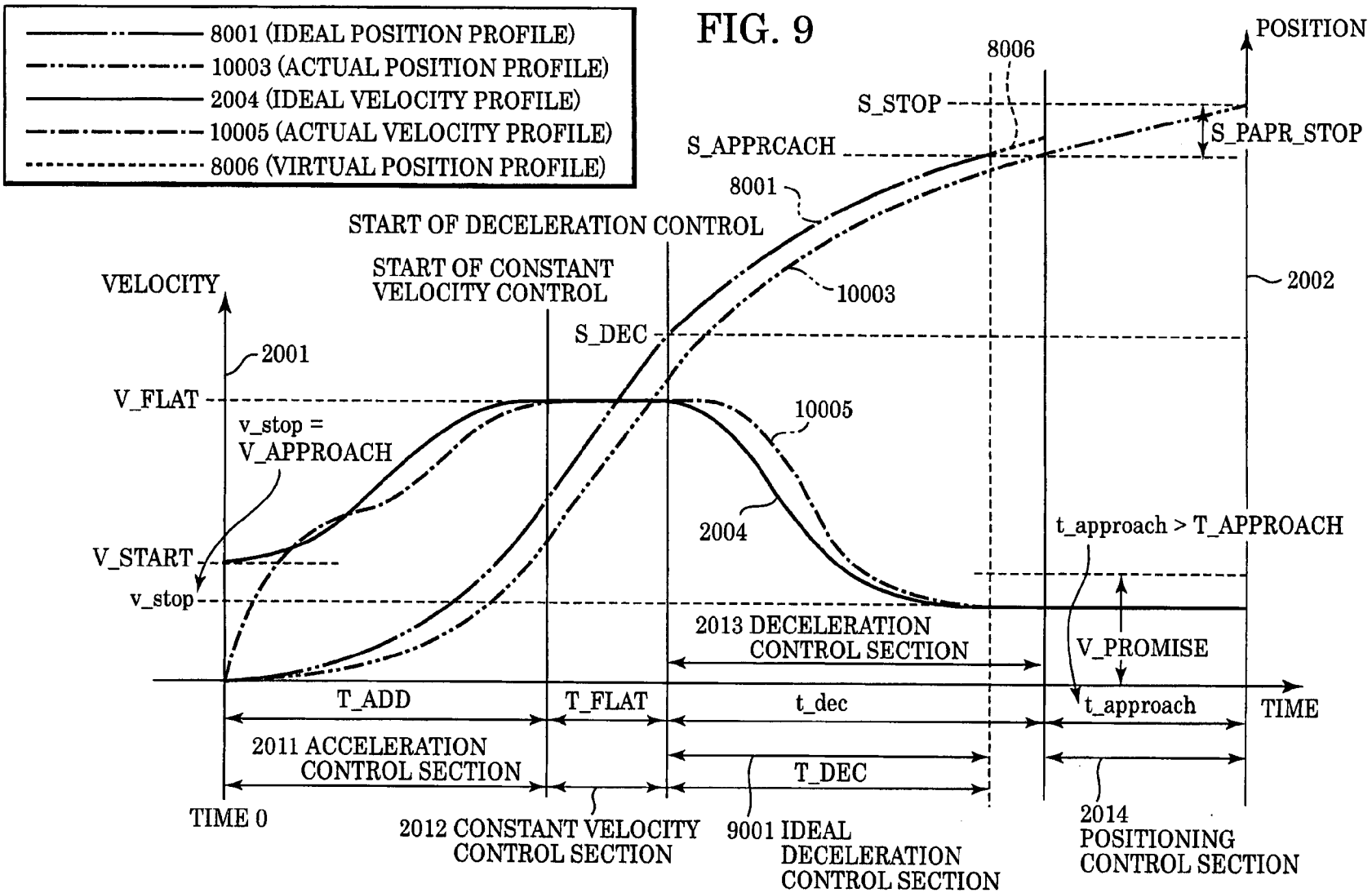
FIG. 9 is a diagram conceptually illustrating an influence of a disturbance on control according to the first embodiment of the invention.

Referring to FIGS. 7, 8, and 9, the LF control process and the influence of the disturbance in the present embodiment are described in further detail below. In those figures, each horizontal axis indicates the time. Each vertical axis 2001 on the left-hand side indicates the velocity, and each vertical axis 2002 on the right-hand side indicates the position.

FIG. 7 indicates a case in which the immediately-before-stop velocity v_stop has an average value equal to an ideal value V_APPROACH (in t_approach=T_APPROACH). FIG. 8 indicates a case in which t_approach<T_APPROACH, that is, the process is completed earlier in time than the predicted time. FIG. 9 indicates a case in which t_approach>T_APPROACH that is, the process is completed later in time than the predicted time.

8001 indicates an ideal position profile, and 2004 indicates an ideal velocity profile. The ideal position profile 8001 includes four control sections, an acceleration control section 2011, a constant velocity control section 2012, a deceleration control section 2013, and a positioning control section 2014.

In the ideal velocity profile 2004, V_START denotes an initial velocity, and V_FLAT denotes a velocity in the constant velocity control section 2012. V_APPROACH denotes a velocity in the positioning control section. V_PROMISE denotes a maximum allowable value of the immediately-before-stop velocity. This requirement must be met to achieve required positioning accuracy. v_stop denotes an actual value of the immediately-before-stop velocity that may vary due to a disturbance that can occur in the actual driving operation. V_APPROACH is set to be sufficiently small so that v_stop never becomes greater than V_PROMISE even if any variation occurs in velocity during the actual driving operation.

In the present embodiment, position servo control is performed in sections 2011, 2012, and 2013, and velocity servo control is performed in section 2014. In FIGS. 7, 8, and 9, each curve 8001 indicates an ideal position profile in the position servo control process. Each curve 2004 indicates an ideal velocity profile in the velocity servo control process and a target velocity profile that should be achieved to follow up the ideal position profile in the position servo control process.

The ideal position profile 8001 is set for each of the sections 2011, 2012, and 2013 in which the position servo control is performed. However, the ideal position profile 8001 is calculated only up to S_APPROACH because the servo control mode is switched into the velocity servo at S_APPROACH, and thus the ideal position profile is no longer needed after S_APPROACH is reached. In the ideal position profile 8001, the deceleration time T_DEC needed for deceleration is constant regardless of the actual driving, and a control section corresponding to the deceleration time T_DEC is denoted as an ideal deceleration control section 9001.

In FIGS. 7, 8, and 9, respective curves 8003, 9003, and 10003 indicate actual position profiles in a situation having a disturbance. In the position servo control, a delay inevitably occurs. Thus, the curves 8003, 9003, and 10003 are delayed with respect to the curve 8001. This means that, in general, when the ideal position profile 8001 reaches its end, the actual position does not yet reach S_APPROACH. In the present embodiment, during a period from the end of the ideal position profile 8001 to a time at which the actual position reaches S_APPROACH, a virtual ideal position profile 8006 is used instead of a target position value in the position servo control. The virtual ideal position profile 8006 is given by a straight line having the same gradient as that of the ideal position profile 8001 at its end point and extending from the end point of the ideal position profile 8001. Curves 8005, 9005, and 10005 indicate actual physical driving velocity profiles of the motor. When the ideal position profile 8001 is given as the input to the feedback control system, the velocity is controlled so as to follow up the ideal velocity profile with a slight delay, such that in the positioning control section 2014 the immediately-before-stop velocity becomes sufficiently close to the ideal velocity V_APPROACH to achieve high positioning accuracy. The transition from the deceleration control section 2013 to the positioning control section 2014 occurs just at S_APPROACH regardless of the actual driving velocity.

S_DEC denotes a position at which the constant velocity control section 2012 ends and the deceleration control section 2013 starts. Note that S_DEC is defined in the ideal position profile 8001, and thus S_DEC does not depend on a disturbance that can occur in the actual driving operation.

In FIGS. 7, 8, and 9, S_APPROACH denotes a position at which the deceleration control section 2013 ends and the positioning control section 2014 starts, and S_STOP denotes a stop position. T_ADD is a time spent to perform the acceleration control section 2011, and T_DEC is a time spent to perform the deceleration control section 2013. T_FLAT is a time spent to perform the constant velocity control section 2012. T_FLAT has a fixed value determined when the ideal position profile 8001 is set for the total driving distance from the driving start position of 0 to the stop position S_STOP. T_APPROACH is a time spent to perform the positioning control section 2014. T_APPROACH is a time needed to move the paper by a distance S_APR_STOP from the position S_APPROACH at which the positioning control section 2014 start to the step position S_STOP. Note that FIG. 7 shows the position profile and the velocity profile for the case in which the paper moves in the position control section in a substantially ideal manner. However, in practice, it is very difficult to physically move paper in the ideal manner.

In order to perform the positioning at a high speed with high accuracy, it is needed to tune the ideal position profile 8001 depending on the actual system. More specifically, it is desirable to set the ideal position profile 8001 such that the velocity in the constant velocity control section 2012 is set to be as large as allowed by the system performance so as to minimize the time needed for the positioning, the velocity in the positioning control section 2014 is set to be as small as allowed by the system performance so as to maximize the positioning accuracy, and the distances moved in the acceleration control region 2011, the deceleration control region 2013, and the positioning control region 2014 are set to be as short as allowed by the system performance so as to minimize the positioning time. However, the details of the tuning technique are not related to the main subject of the present invention, and thus, in the following discussion, it is assumed that the ideal position profile 8001 has already been optimized.

Let t_approach denote an actual variable value of the time spent to perform the position control section 2014. The value of t_approach can vary owing to a disturbance. Note that in the present embodiment, constants are denoted in uppercase and variables are denoted in lowercase. When there are two expressions that are the same in spelling and one of which is in upper scale and the other in lower scale, the expression in upper scale denotes an ideal constant value and the expression in lower scale denotes an actual variable value corresponding to the ideal constant value.

Figure 10:
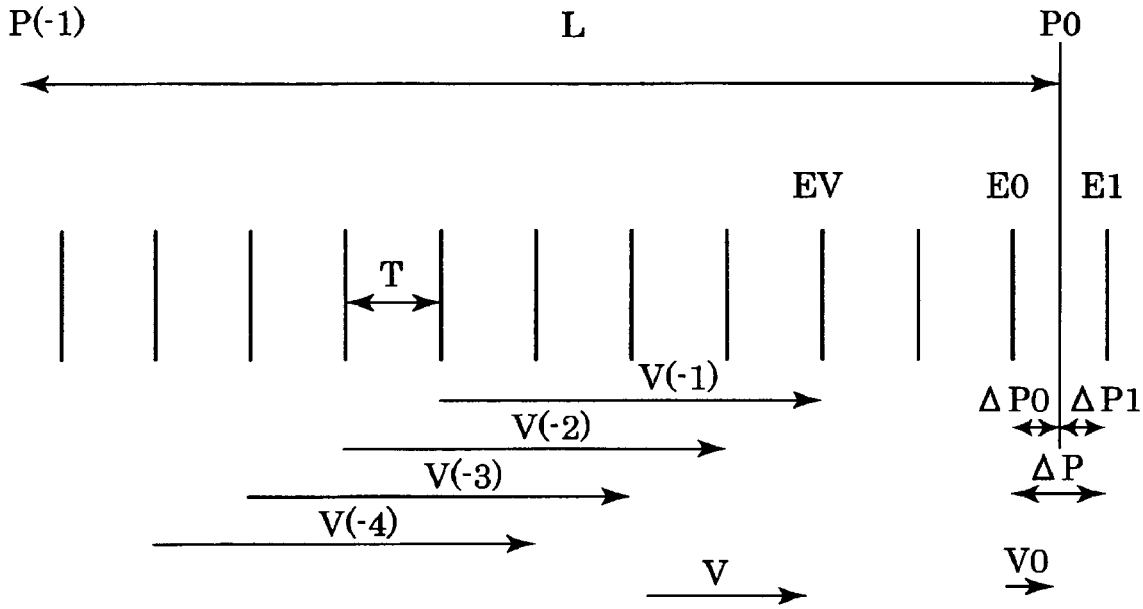
FIG. 10 is a diagram conceptually illustrating the relationship between an encoder signal and a stop position according to the first embodiment of the invention.

FIG. 10 is a diagram illustrating the relationship between the encoder signal and the stop position in the control of the stop position. The control of the stop position is performed in the positioning control section 2014 shown in FIGS. 7 to 9. In FIG. 10, a timing P0 corresponds to the target stop position located between an edge E0 and an edge E1 of the encoder signal.

P(−1) denotes a timing corresponding to a stop position in a previous feeding operation. Paper P is fed by a distance of L from the position corresponding to P(−1). Information indicating the stop position is acquired, for example, based on the distance L and the timing P(−1). P0 denotes the timing corresponding to the stop position (target stop position) in the operation of feeding paper P from the position corresponding to P(1−). Strictly, when a stopping process (described later) is performed at P0, the paper P stops at the stop position a particular time after the stopping process. However, for the purpose of simplicity, it is assumed herein that the paper P stops at P0 immediately when the stopping process is performed at P0.

In FIG. 10, the paper P is fed from left to right, and many encoder signal edges appear at intervals of T as the paper P moves. Note that the timing when the encoder signal edges appear corresponds to the position of the paper P.

The target stop position P0 is located where no encoder signal edge appears (in other words, the stop position P0 does not correspond to any encoder signal edge). An immediately-before-stop edge E0 of the encoder signal appears a feeding distance of ΔP0 before (in FIG. 10, to the left of) the target stop position P0, and an immediately-after-stop edge E1 of the encoder signal appears a feeding distance of ΔP1 after (in FIG. 10, to the right of) the target stop position P0.

When an edge EV appears two edges before (in FIG. 10, to the left of) the edge E0, the velocity is calculated. The timing of calculating the velocity is not limited to two edges before the edge E0, but the timing may be determined in other ways as long as the velocity can be properly calculated.

Figure 11:
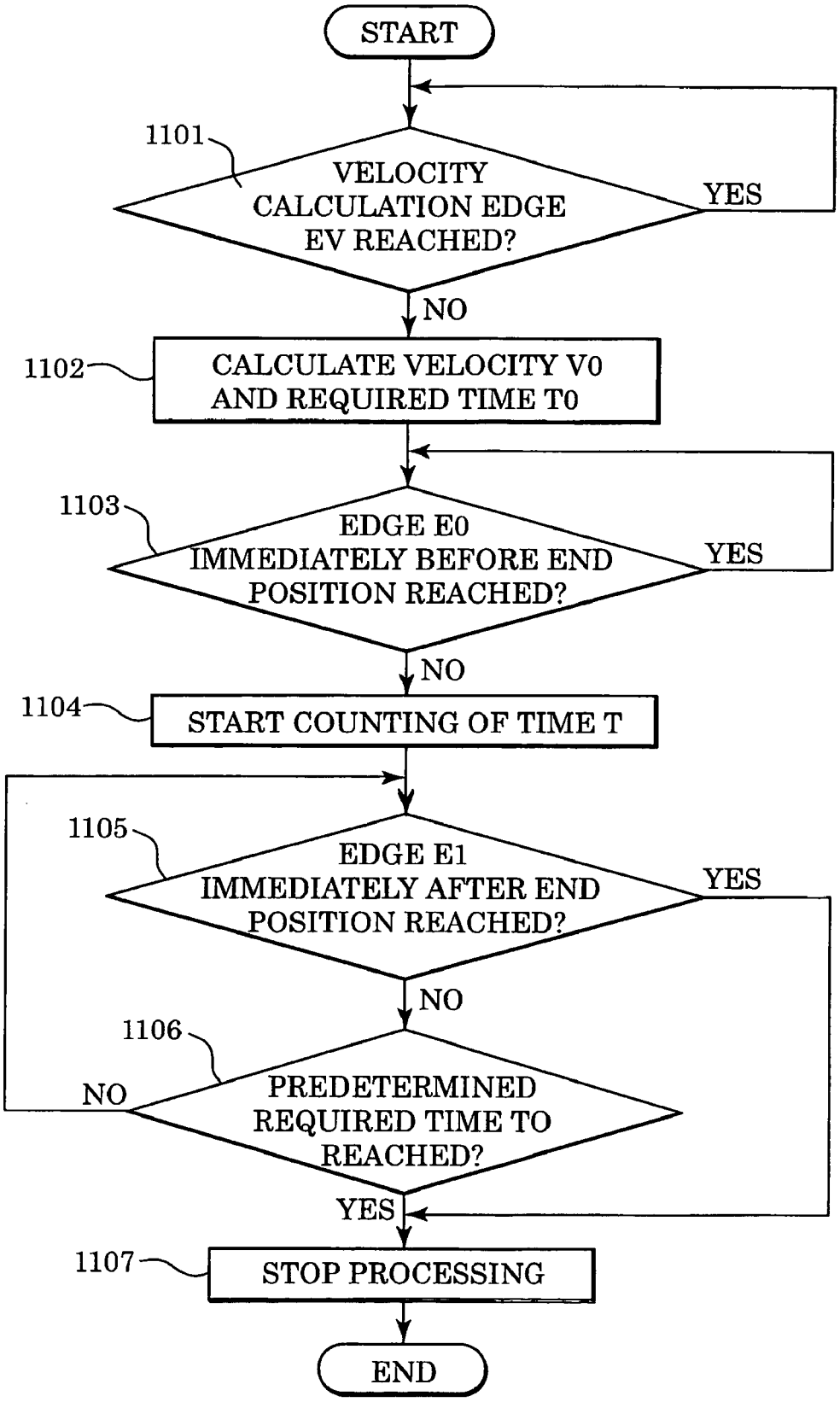
FIG. 11 is a flow chart showing a process of feeding paper to a stop position that does not correspond to any encoder signal edge in accordance with the first embodiment of the invention.

Now, the stopping process is described below with reference to a flow chart shown in FIG. 11. The rotation of the paper feed roller is controlled toward the target stop position by means of the feedback control based on the edge signals of the encoder signal.

The timing of calculating the velocity is in a period (corresponding to the positioning control section 204) in which the velocity is controlled at a particular value (target velocity value). The target velocity is set to be sufficiently small within a range that allows the paper feed roller to rotate in a reliable manner.

When the paper feed roller rotates to a position corresponding to the edge EV (step 1101), the velocity at EV (or near EV) is calculated.

Herein it is assumed that the paper travels the distance ΔP1 at the calculated velocity V. This velocity is denoted by V0. To minimize the error of the velocity V0 calculated from the velocity information output from the encoder, the velocity V0 is calculated from the signal in, for example, 4 periods. That is, the velocity V0 is given by the average of velocities V(−1) to V(−4). As shown in FIG. 10, the sampling period during which each of the velocities V(−1) to V(−4) is calculated is shifted by one interval from one velocity to another. The required time T0 is then calculated from the velocity V0 and the distance ΔP0 corresponding to the encoder slit interval (step 1102).

When the edge E0 is reached (step 1103), counting of time Tc from this point of time is started (step 1104).

Monitoring by means of a hardware interrupt as to whether the edge E1 is reached is also started (step 1105). If the counted time Tc reaches the specified time T0 (step 1106), a stop signal is output and a stopping operation (stopping process) is performed (step 1107).

The above-described process in step 1105 is performed in order to prevent the edge E1 from being passed over before the time Tc reaches the specified time T0. In the low-velocity control section, as described earlier with reference to FIGS. 7 to 9, the time interval at which velocity information is acquired is long, and thus the velocity is not stable and the accuracy of velocity information is low. If the actual velocity is greater than the velocity V0, the target stop position is passed over and the edge E1 is reached before the specified time T0 is reached.

To check whether the above-described situation occurs, a checking is performed as to whether the next edge appears. If the result of step 1105 is YES, the stop operation (stop processing) is performed when the edge E1 is reached. That is, when the edge E1 is detected, the stop operation is performed (step 1107) even if the counted time T has not yet reached the time T0. The edge E1 is referred to as an assurance edge. As described above, when the calculated velocity is greatly different from the actual velocity (that is, when the calculated velocity is not equal to the actual velocity), the encoder signal (the edge E1) is given higher priority in the stop operation (stop processing). This ensures that in the worst case the stop position error is smaller than the edge-to-edge distance ΔP (for example, between a rising edge of phase A and a rising edge of phase B) in the two edge/two phase control scheme.

The stop operation (stop processing) in step 1107 is performed by changing the electric power applied to the motor to a value (that may be equal to 0) smaller than a value that is applied in the low-velocity control section.

In the present embodiment, the power is switched to a small value that does not allow the motor to rotate. Note that the polarity of the applied voltage is maintained positive.

By performing the stop operation in the above-described manner, it becomes possible to suppress the stop position error due to imperfections of the driving system such as an elastic deformation charge force, a mechanical backlash or clearance, and/or cogging of the motor. The stop position error due to such imperfections occurs after the electric power is switched at the target stop position (that is, after the stop operation), and the stop position error can be minimized by applying the small electric power to the motor after the motor is stopped. Thus, the difference between the actual stop position and the target stop position is minimized.

The velocity V near EV is given by the average velocity V0 for the following two reasons.

Firstly, in the low velocity control section immediately before the stop position, the low frequency at which velocity information is updated causes a reduction in accuracy of the calculated velocity. To minimize this reduction in accuracy, the velocity is calculated from plural pieces of velocity information. Note that the calculation of the average velocity is not limited to the simple calculation of the average value, but the average value may be calculated taking into account a change in velocity (that is, acceleration).

Secondly, because the servo period of time is long (for example, about 1 msec), there is a possibility that the target stop position is reached before the calculation of the time T0 needed to reach the stop position based on the encoder signal E0 is completed and the stop operation is performed based on the calculated time T0.

If the servo period of time is short enough and a long enough time is available before the stop operation, velocity information acquired at the edge E0 may be directly used.

Figure 13A:
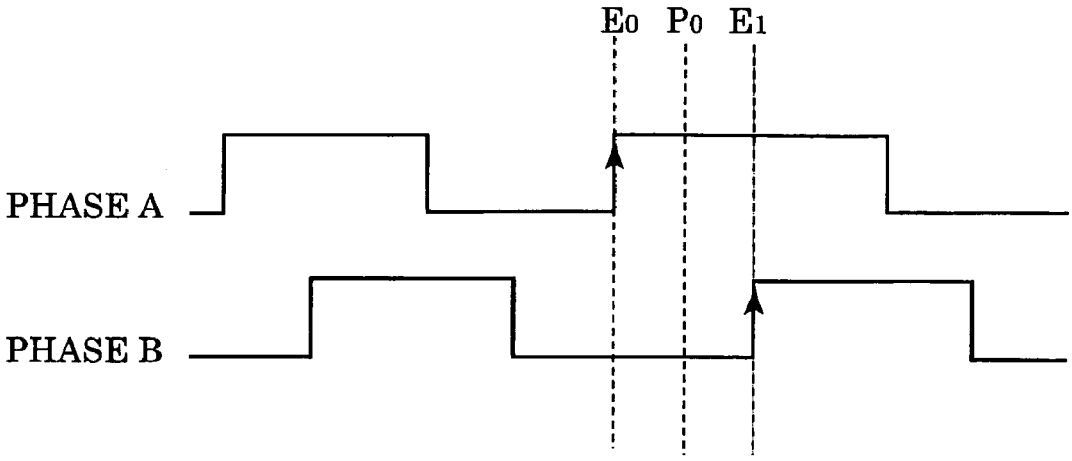
FIGS. 13A to 13C are diagrams conceptually illustrating the relationship between an encoder signal and a stop position according to the first and second embodiments of the invention.

Referring to FIG. 13A, a technique of improving the stop position accuracy is described for the case in which the stop position does not correspond to any encoder signal edge. This stop processing technique refers to a non-edge stop operation.

Herein, it is assumed that a rising edge of phase A is used as the edge E0 that is used as a reference point based on which the timing of the stop operation is determined. The timing of performing the stop operation is denoted by P0, and a rising edge of phase B is denoted by E1, which serves as the assurance edge.

Figure 13B:
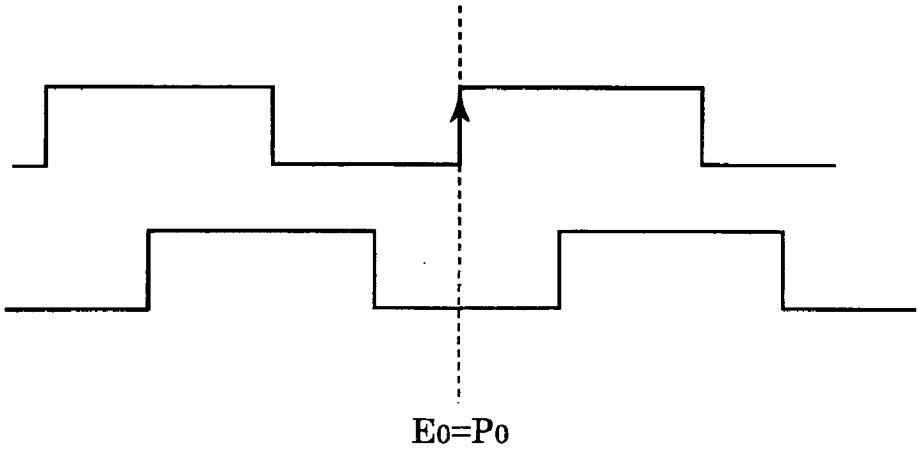

FIG. 13B illustrates the timing associated with the stop operation in which the stop position resolution is determined by the encoder resolution. That is, the stop operation is performed at a position (timing) corresponding to an edge of the encoder signal (hereinafter, this stop operation is referred to as an on-edge stop operation). In this technique, the stop operation is performed at a rising edge of phase A.

Whether the stop operation is performed in the on-edge stop operation mode or the in the non-edge stop operation mode depends on the stop position. That is, if the target stop position corresponds to an edge of the encoder signal, the on-edge stop operation mode is selected. However, if the target stop position does not correspond to any edge of the encoder signal, the non-edge stop operation mode is selected.

In the on-edge stop operation mode, the stop operation is performed at a rising edge of phase A, and thus edge E0=P0.

By using the same edge of the encoder signal as a reference timing signal for both the non-edge stop operation and the on-edge stop operation an adverse effect of the period error specific to the encoder can be avoided. That is, use of the same edge (rising edge of phase A allows achievement of highest accuracy.

Note that the closer to the edge E0 the target stop position in the non-edge stop operation is, the shorter the time T1 during which the paper moves at the representative calculated velocity V1 that is not necessarily accurate, and thus the smaller the stop position error with reference to the target stop position is.

As can be understood from the above description, the present embodiment allows a wider choices for the encoder sensor and the encoder wheel, and thus the present embodiment can provide a paper feed controller (printer) that is high resolution, low in cost, and small in size.

Second Embodiment

A second embodiment is described below with reference to FIG. 13C.

Herein, only different points from those of the first embodiment are described.

Figure 13C:
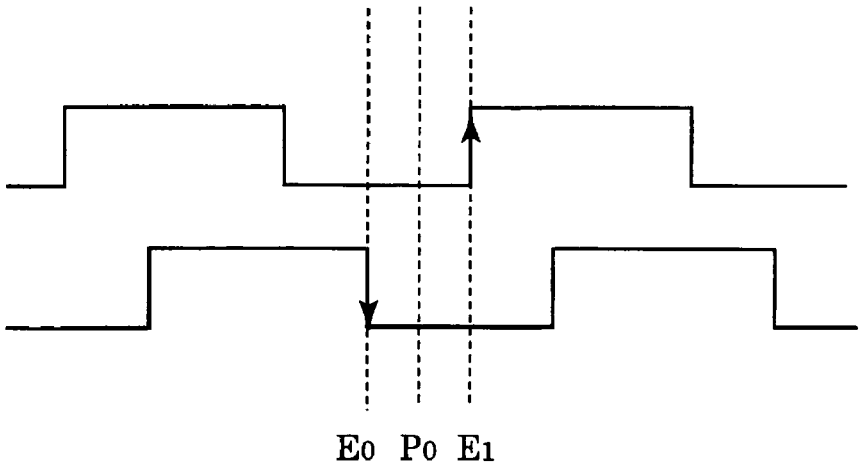

In this second embodiment, as shown in FIG. 13C, unlike the first embodiment, the stop operation is performed at a position (timing) that does not correspond to any edge of the encoder signal but that is determined by using a falling edge of phase B as a reference point, and a rising edge of phase A is used E1 (assurance edge).

This operation mode is useful in particular when the calculation velocity has a large error and the stop operation is often performed at the assurance edge E1. In this operation mode, at a position (timing) corresponding to an edge of the encoder signal shown in FIG. 13B, the stop signal for the stop operation is output exactly at the edge (a rising edge of phase A). This makes it possible to minimize the difference in stop position accuracy between the on-edge stop operation mode and the non-edge stop operation mode.

In particular, when a low-cost encoder having a low edge resolution is used, the immediately-before-stop velocity is set to be rather high (because if the immediately-before-stop velocity is set to be low, the paper stops before the target stop position is reached), and thus there is a high possibility that the assurance edge is reached. Even in such a situation, the stop operation according to the present embodiment provides high stop position accuracy.

In the present embodiment, as described above, even when the target stop position does not correspond to any edge of the encoder signal, the velocity is calculated, and from the calculated velocity, the timing of the stop operation is determined with reference to an edge signal appearing immediately before the target stop position. Thus, it is possible to perform the stop operation at a position that corresponds to no edge of the encoder signal.

Even if an unallowable error occurs in the calculation of the velocity or even if an unallowable fluctuation occurs in the velocity, it is assured that the stop operation is performed at the assurance edge, and thus the stop position accuracy is guaranteed.

As can be understood from the above description, the present embodiment allows a wider choices for the encoder sensor and the encoder wheel, and thus the present embodiment can provide a paper feed controller (printer) that is high resolution, low in cost, and small in size.

Third Embodiment

A third embodiment of the present invention is described below. A printer according to the third embodiment has a similar structure to that of the first embodiment, and thus a duplicated description of the structure is not given herein. The present embodiment is different from the first embodiment in terms of the following points.

Figure 12:
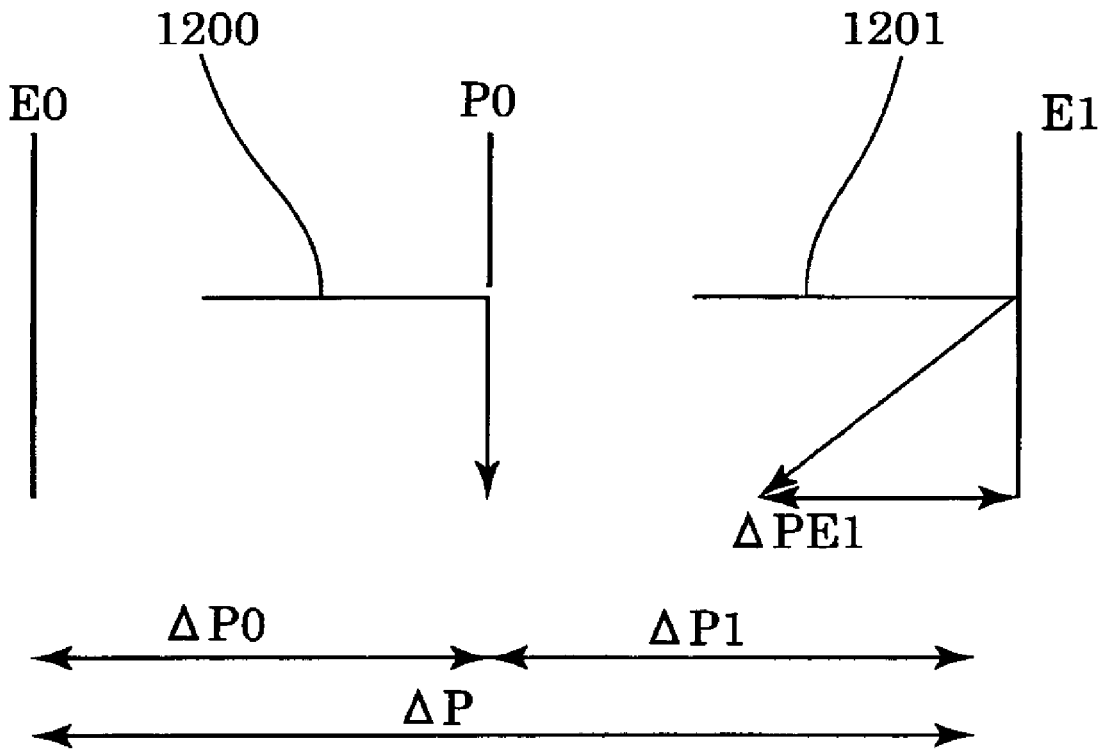
FIG. 12 is a diagram conceptually illustrating the relationship between an encoder signal and a stop position according to a third embodiment of the invention.

In FIG. 12, 1200 shows an operation in a situation in which the actual velocity is equal to the velocity V0, and 1201 shows an operation in a situation in which the actual velocity is higher than the velocity V0. In the case of 1201, before the time calculated based on the velocity V0 has elapsed, the paper reaches the edge E1 appearing immediately after the target stop position (the result of step 1105 becomes YES).

When the paper reaches a position corresponding to the edge E1 after the target stop position is passed over, the stop operation is performed (step 1107) by changing the electric power supplied to the motor to a level that is opposite in polarity and that is small enough not to allow the motor to rotate in the opposite direction.

In this technique, the stop position becomes a very short distance ΔPE1 (about few microns) before the stop position that occurs in the technique in which low electric power with the same polarity is applied to the motor in the stop state to suppress the stop position error due to imperfections of the driving system such as the elastic deformation charge force, the mechanical backlash or clearance, and/or cogging of the motor.

That is, when the target stop position is passed over, the stop position is moved backward toward the target stop position, and thus the relative stop position error can be reduced.

The technique disclosed herein in the third embodiment may be combined with the technique disclosed in the first or second embodiment.

OTHER EMBODIMENTS

In the embodiments described above, the velocity information is calculated from the encoder signal in four periods, the number of periods is not limited to four. Furthermore, the resolution of the encoder and the resolution of the print head are not limited to the values used in the embodiments described above.

Although the present inventions has been described above with reference to the technique of controlling the paper feed mechanism for feeding a printing medium such as paper in the printer using the print head, the present invention may also be applied to other apparatus such as an image input apparatus for reading an image of a document or the like.

Furthermore, the object to be fed is not limited to the printing medium in the printer, but the present invention may also be applied to the control of moving a part such as a stage or the like in an electronic device or an electronic apparatus such as a testing apparatus.

According to the present invention, as described above, it is possible to control the paper feed mechanism such that paper can be stopped with high accuracy not only at a position corresponding to an encoder signal edge but also at a position corresponding to no encoder signal edge between adjacent encoder signal edges.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A paper feed controller comprising:

a paper feed unit configured to feed sheets;

an encoder unit configured to output two pulse signals periodically by differing their phases with each other in response to a driving of the paper feed unit;

a control unit controlling the driving of the paper feed unit based on the pulse signals;

an acquisition unit acquiring a driving velocity of the paper feed unit before the paper feed unit stops driving;

a determination unit determining the edge of either one of the two pulse signals output by the encoder unit and a timing to execute stop processing after occurrence of the edge based on the volume of the driving and the driving velocity of the paper feed unit; and a judging unit judging, following the occurrence of the edge of the pulse signal determined by the determination unit, whether the edge of another pulse signal output by the encoder unit occurred, wherein the control unit executes the stop processing to stop the drive of the paper feed unit based on the timing determined by the determination unit, and also executes the stop processing when the judging unit judges that the edge of another pulse signal occurred before the timing.

2. A paper feed controller according to claim 1, wherein the control unit controls a servo of a DC motor configured to drive the paper feed unit and acquires the driving velocity during the period controlling the stop position executed after a deceleration control.

3. A recording apparatus having the paper feed controller according to claim 1, wherein the recording apparatus executes a recording by using a recording head.

4. A paper feed controller comprising:

a paper feed unit configured to feed sheets;

an encoder unit configured to output two pulse signals periodically by differing their phases with each other in response to a rotation of the paper feed unit;

a control unit controlling the rotation of the paper feed unit based on the pulse signals;

an acquisition unit acquiring a rotation velocity of the paper feed unit before the paper feed unit stops rotating, a determination unit determining the edge of either one of the two pulse signals output by the encoder unit and a timing to execute stop processing after occurrence of the edge based on the volume of the rotation and the rotation velocity of the paper feed unit; and a judging unit judging, following the occurrence of the edge of the pulse signal determined by the determination unit, whether the edge of another pulse signal output by the encoder unit occurred, wherein the control unit executes the stop processing to stop the rotation of the paper feed unit based on the timing determined by the determination unit, and also executes the stop processing when the judging unit judges that the edge of another pulse signal occurred before the timing.

5. A paper feed controller according to claim 4, wherein the control unit controls a servo of a DC motor which is a rotary driving source of the paper feed unit and acquires the rotation velocity during the period controlling the stop position executed after a deceleration control.

6. A recording apparatus having the paper feed controller according to claim 4, wherein the recording apparatus executes a recording by using a recording head.

* * * * *